US012538959B2

(12) United States Patent
Parisotto et al.

(10) Patent No.: US 12,538,959 B2
(45) Date of Patent: Feb. 3, 2026

(54) SOLE ASSEMBLY FOR FOOTWEAR AND FOOTWEAR EQUIPPED THEREWITH

(71) Applicant: CALZATURIFICIO S.C.A.R.P.A. S.P.A., Asolo (IT)

(72) Inventors: Davide Parisotto, Asolo (IT); Francesco Orrico, Asolo (IT); Carlo Pozzobon, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 0 days.

(21) Appl. No.: 18/643,276

(22) Filed: Apr. 23, 2024

(65) Prior Publication Data

US 2024/0358110 A1 Oct. 31, 2024

(30) Foreign Application Priority Data

Apr. 28, 2023 (IT) ..... 102023000008340

(51) Int. Cl.
*A43B 13/12* (2006.01)
*A43B 13/18* (2006.01)
*A43B 13/22* (2006.01)

(52) U.S. Cl.
CPC ..... *A43B 13/122* (2013.01); *A43B 13/187* (2013.01); *A43B 13/22* (2013.01)

(58) Field of Classification Search
None
See application file for complete search history.

(56) References Cited

U.S. PATENT DOCUMENTS

| | | | | |
|---|---|---|---|---|
| 7,299,567 | B2 * | 11/2007 | Berend | A43B 23/087 36/108 |
| 9,615,625 | B1 * | 4/2017 | Huard | A43B 13/141 |
| 9,930,927 | B2 * | 4/2018 | Luedecke | A43B 13/127 |
| 10,271,614 | B2 * | 4/2019 | Huard | A43B 13/026 |
| 10,561,198 | B2 * | 2/2020 | Luedecke | A43B 13/127 |
| 10,897,961 | B2 * | 1/2021 | Baucom | A43B 13/223 |
| 2010/0122471 | A1 | 5/2010 | Edington et al. | |
| 2017/0079373 | A1 * | 3/2017 | Huard | A43B 7/144 |
| 2019/0150562 | A1 | 5/2019 | Bartel et al. | |
| 2021/0059355 | A1 | 3/2021 | Vizy et al. | |

OTHER PUBLICATIONS

Search Report issued in Italian Application No. 102023000008340.

* cited by examiner

*Primary Examiner* — Jila M Mohandesi
(74) *Attorney, Agent, or Firm* — The Belles Group, P.C.

(57) ABSTRACT

A sole assembly for sports footwear having an oblong plate-like structure and comprising: an outsole with a treaded profile, which is adapted to grip the ground and is made of polymeric material with a high friction coefficient; at least one shock-absorbing layer with plate-like and elastically deformable structure, separate and distinct from the outsole, which is made of a first polymeric material foam and is located immediately above the outsole; and at least one plate-like pad with elastically deformable structure, separate and distinct from the outsole and the shock-absorbing layer, which is embedded inside the shock-absorbing layer close to the outsole, and is made of a second polymeric material foam having a compression elasticity modulus and/or a resilience lower than those of the shock-absorbing layer.

20 Claims, 4 Drawing Sheets

SOLE ASSEMBLY FOR FOOTWEAR AND FOOTWEAR EQUIPPED THEREWITH

CROSS-REFERENCE TO RELATED APPLICATIONS

This patent application claims priority from Italian patent application no. 102023000008340 filed on Apr. 28, 2023, the entire disclosure of which is incorporated herein by reference.

TECHNICAL FIELD

The present invention relates to a sole assembly for sports footwear and to a sports footwear provided with such sole assembly.

More specifically, the present invention relates to a sole assembly for mountain boots and to a mountain boot provided with such sole assembly. Use to which the following description will make explicit reference without thereby losing generality.

STATE OF THE ART

As is known, mountain boots are sports footwear usually of medium thermal insulation, which end above the ankle and are structured to allow the user to walk on mountain paths, rocks, scree, frozen terrain, snow-covered surfaces, and the like, ensuring adequate ankle support and protection.

The currently most popular mountain boots basically consist of a leather and/or synthetic upper, generally with a waterproof and breathable structure, which is shaped so as to accommodate and protect the user's foot and leg usually up to the base of the calf and is suitably stiffened by a front toe cap and a rear counter, both usually made of rigid polymeric material; a sole assembly with an oblong plate-like structure, which is stably fixed underneath the upper by sewing and/or gluing so as to cover the entire sole of the user's foot and which is provided with a treaded-profile outsole made of vulcanized rubber or other elastomeric material with a high friction coefficient; and a lace or other manually-operated closing system, which is capable of tightening the upper on the user's foot.

In addition to the treaded-profile outsole, the sole assembly of mountain boots traditionally also comprises: a thick shock-absorbing layer with soft and flexible structure, called a wedge or midsole, which is made of polymeric material foam and is interposed between the outsole and the bottom or insole of the upper; and optionally also a plate-like insert with a rigid or semi-rigid structure, which is made of polymeric or composite material and is embedded into the shock-absorbing layer so as to give greater torsional and/or flexural rigidity to the sole assembly.

In addition, in the most sophisticated and expensive mountain boots, the shock-absorbing layer is often longitudinally divided into a front part and a rear part, which are contiguous and complementary to each other and differ in the density of the polymeric material foam.

In greater detail, the rear part of the shock-absorbing layer, i.e. the part underneath the heel of the user, usually has a higher density than that of the front part, so as to give the user greater stability and support during walking.

Clearly, due to the particular use for which the footwear is intended, the density and surface hardness of the shock-absorbing layer cannot in any case descent below a certain value, because the perimeter of the shock-absorbing layer must still be able to withstand impacts and abrasions from sharp rocks, and the like.

Unfortunately, this construction constraint on the mechanical properties of the intermediate shock-absorbing layer affects the ability of the outsole to adapt to the morphology of the underlying ground, with the limitations that this entails.

SUMMARY OF THE INVENTION

Aim of the present invention is to provide a sole assembly which has a better ability to adapt to the morphology of the underlying ground.

In accordance with these aims, according to the present invention there is provided a sole assembly for sports footwear as defined in claim 1 and preferably, though not necessarily, in any one of the claims dependent thereon.

According to the present invention, there is also provided a footwear as defined in claim 15.

BRIEF DESCRIPTION OF THE FIGURES

The present invention will now be described with reference to the accompanying drawings, which illustrate a non-limiting embodiment thereof, wherein.

DETAILED DESCRIPTION OF THE EMBODIMENTS

With reference to FIGS. 1 to 4, number 1 denotes, as a whole, a sole assembly 1 for sports footwear.

In greater detail, the sole assembly 1 has a treaded profile and is particularly adapted to be incorporated in a sports shoe 100, which advantageously ends above the ankle and is preferably structured for walking, in relative safety, on mountain paths, rocks, scree, frozen terrain, snow-covered surfaces, and the like.

Figure 1:
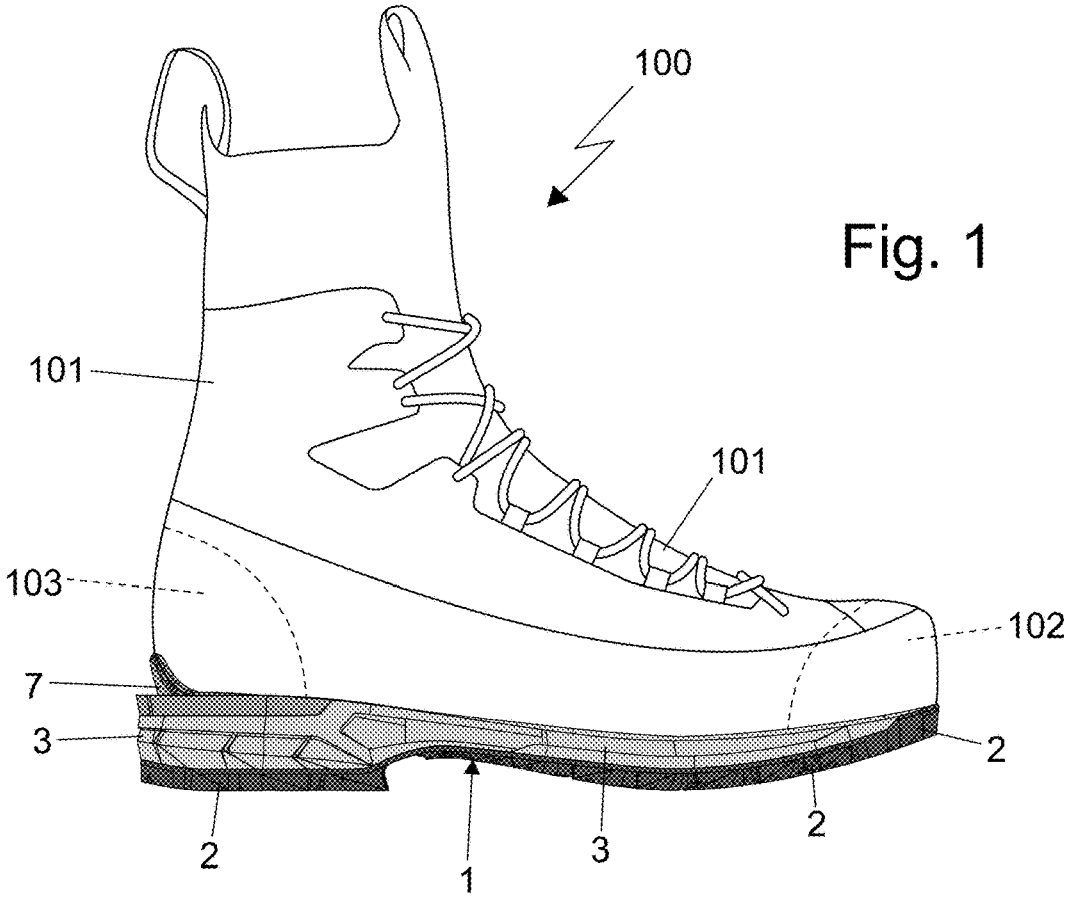
FIG. 1 is a side view of a sports shoe provided with a sole assembly made according to the teachings of the present invention.
Figure 2:
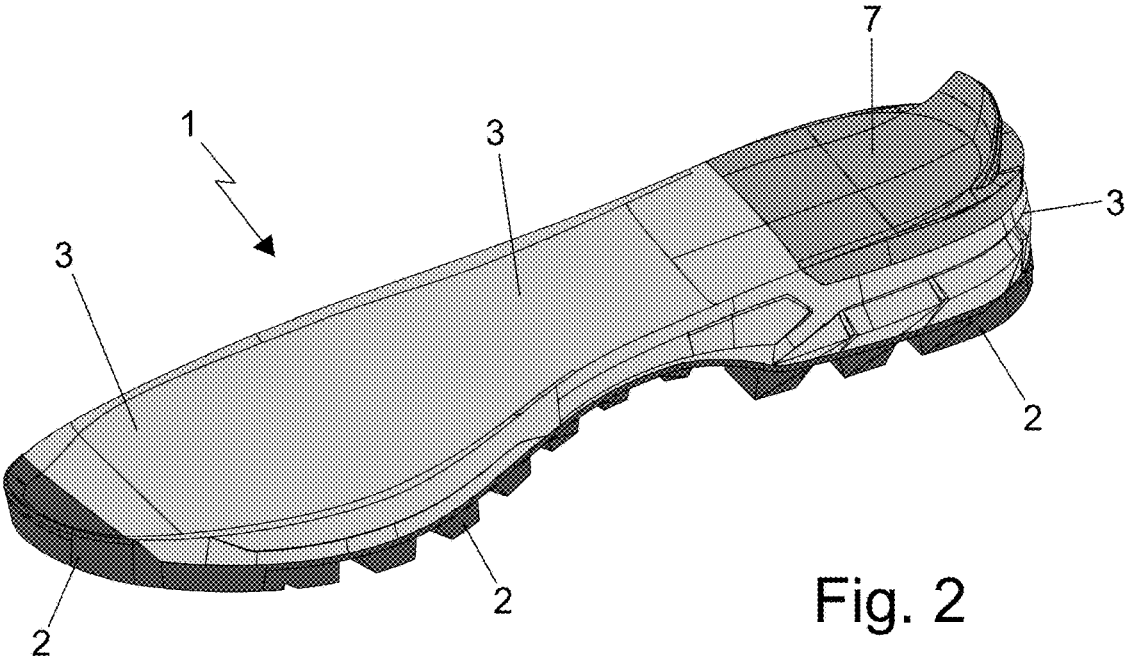
FIG. 2 is a perspective view of the sole assembly shown in FIG. 1.
Figure 4:
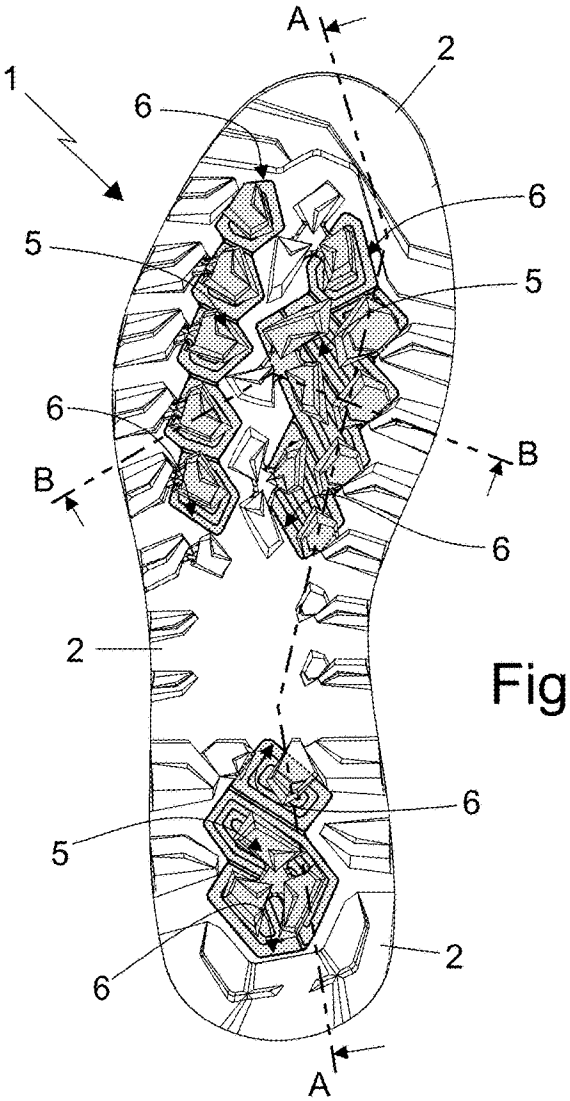
FIG. 4 is a bottom view of the sole assembly shown in FIG. 2.
Figure 3:
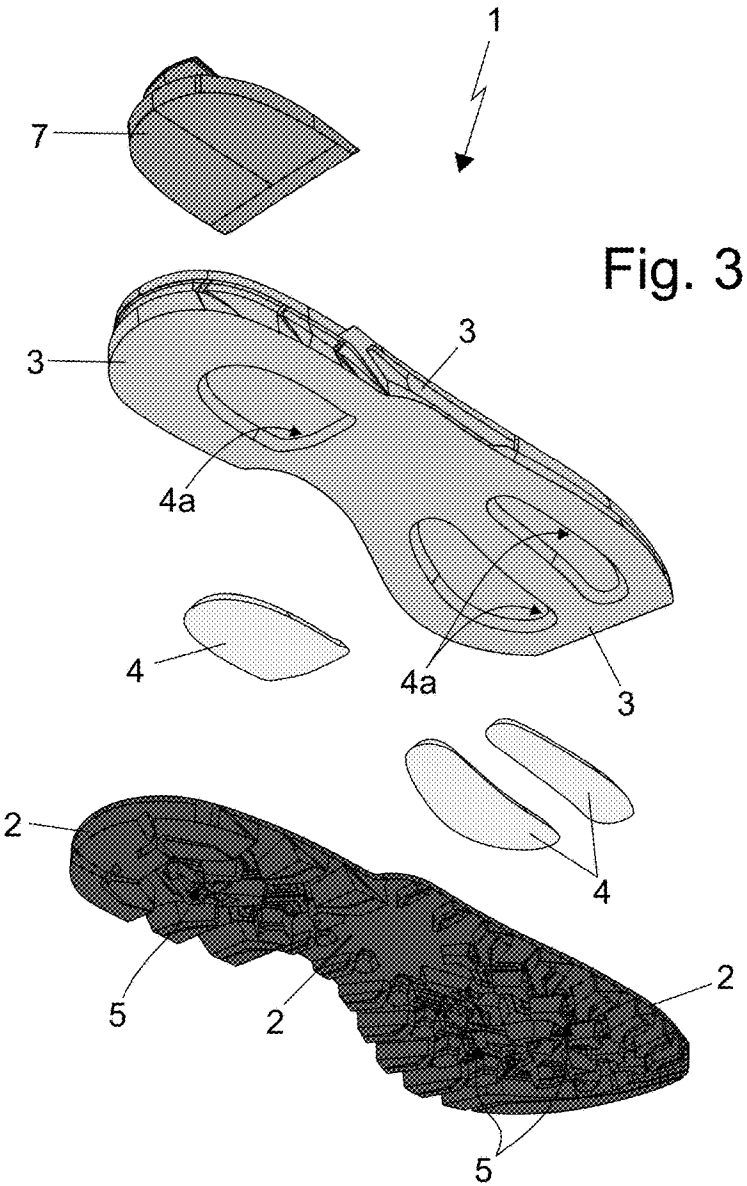
FIG. 3 is a partially exploded view of the sole assembly shown in FIG. 2.
Figure 5:
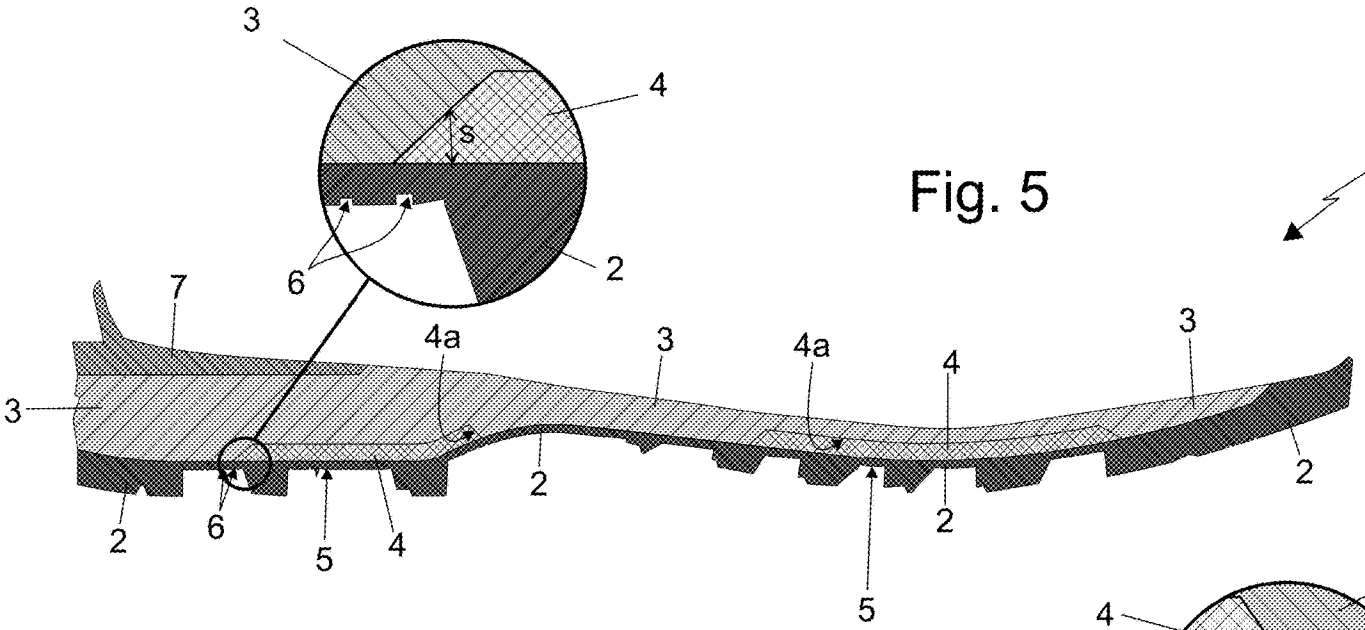
FIGS. 5 and 6 are two side views of the sole assembly shown in FIG. 4, respectively sectioned along the section lines A-A and B-B.
Figure 6:
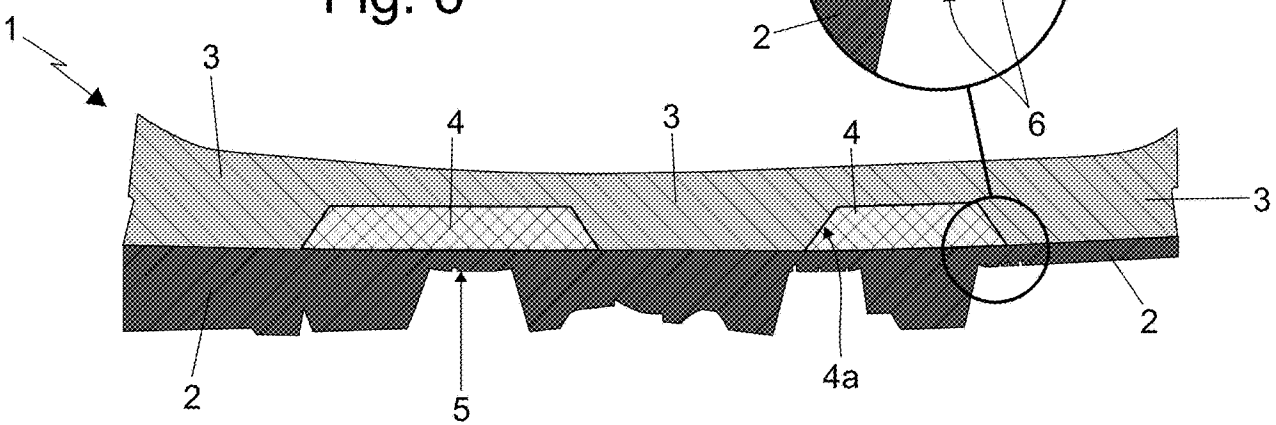

In other words, the sole assembly 1 is particularly adapted to be incorporated in a mountain boot or the like. With reference to FIG. 1, in particular, the sports footwear 100 preferably comprises an upper 101, advantageously with a waterproof and/or breathable structure, which is preferably mainly made of leather, synthetic leath and/or synthetic fabric, and is shaped and structured so as to accommodate and protect the foot and preferably also the lower part of the user's leg, advantageously roughly up to the base of the calf. The upper 101 is optionally also stiffened by a front toe cap 102 and/or a rear counter 103 preferably made of rigid or semi-rigid polymeric material.

The sole assembly 1 is attached, or adapted to be attached, firmly underneath the upper 101 and is shaped and dimensioned so as to cover and protect the entire sole of the user's foot.

In other words, the sole assembly 1 has an oblong plate-like structure and is adapted to be immovably attached to the upper 101, preferably by sewing and/or gluing.

Preferably, the part of the sole assembly 1 that is located immediately beneath the user's heel, moreover, has a thickness greater than of the part that is instead located below the user's forefoot.

With reference to FIGS. 2, 3, 4 and 5, the sole assembly 1 comprises: an outsole 2 with a flexible plate-like structure, which has a treaded profile so as to grip the ground and is made of a polymeric material with a high friction coefficient; and at least one shock-absorbing layer 3 with a plate-like and elastically deformable structure, separate and distinct from the outsole 2, which is made of a first polymeric material foam and is located immediately above the outsole 2, so as to be interposed between the outsole 2 and the upper 101, or rather between the outsole 2 and the bottom or insole of the upper 101.

In greater detail, the outsole 2 preferably has a monolithic structure and has a treaded profile shaped so as to rest and grip on the ground.

Even more specifically, the outsole 2 is provided with a series of protruding knobs, which are preferably appropriately distributed and shaped so as to grip rocks, and dirt and/or muddy terrain.

The shock-absorbing layer 3, on the other hand, preferably has a monolithic structure and is preferably contiguous and attached to the outsole 2 in a substantially immovable manner, advantageously by gluing.

Preferably, the shock-absorbing layer 3 is furthermore made of a polymeric material that differs from the material forming the outsole 2 for polymeric composition and/or density and/or hardness and/or elastic modulus.

In greater detail, the outsole 2 is preferably made of vulcanized rubber or other elastomeric material with a high friction coefficient such as, for example, the Mont compound produced by the Italian company VIBRAM SPA.

Preferably, the outsole 2 moreover has a surface hardness (UNI 4916) ranging between 50 and 100 ShoreA.

In greater detail, the outsole 2 has a surface hardness (UNI 4916) advantageously ranging between 50 and 60 ShoreA, or between 60 and 70 ShoreA, or between 70 and 80 ShoreA, or between 80 and 90 ShoreA.

The shock-absorbing layer 3, on the other hand, is preferably made of polyurethane foam, i.e. it is made of expanded polyurethane, advantageously with an ether-based or ester-based.

In a different embodiment, however, the shock-absorbing layer 3 could also be made of ethylene-vinyl-acetate foam, traditionally called EVA.

In addition, the shock-absorbing layer 3 has a nominal density preferably ranging between 0,35 and 0,45 $Kg/dm^3$ (kilograms per cubic decimetre) and/or a Compression-set value ranging between 25% and 35%.

Preferably, the shock-absorbing layer 3 furtermore has a surface hardness (UNI 4916) lower than that of the outsole 2 and advantageously ranging between 40 and 70 ShoreA.

In greater detail, In the shock-absorbing layer 3 advantageously has a surface hardness (UNI 4916) ranging between 40 and 50 ShoreA, or between 50 and 60 ShoreA.

With reference to FIGS. 3 to 6, the sole assembly 1 additionally comprises at least one plate-like pad 4 with elastically deformable structure, separate and distinct from the outsole 2 and the shock-absorbing layer 3, which is embedded inside the shock-absorbing layer 3 adjacent to the outsole 2 and is made of a second polymeric material foam having a compression elasticity modulus and/or a resilience lower than those of the shock-absorbing layer 3.

In other words, the plate-like pad 4 is softer than the shock-absorbing layer 3 surrounding it.

In greater detail, the compression elasticity modulus and/or the resilience of the second polymeric material foam preferably is/are at least 10% lower than those of the first polymeric material foam.

In addition, the hardness of the second polymeric material foam is also advantageously 10-15 ShoreA points lower than that of the first polymeric material foam.

Preferably, the plate-like pad 4 is moreover embedded in the shock-absorbing layer 3 so as to be contiguous with the outsole 2, and advantageously also has a thickness that is always less than the thickness of the surrounding shock-absorbing layer 3.

In other words, the plate-like pad 4 is embedded inside complementarily-shaped housing seat 4*a*, which is a preferably partially bounded by the outsole 2.

In addition, the plate-like pad 4 is preferably made of the same polymeric material as the shock-absorbing layer 3, and therefore has a lower nominal density than the shock-absorbing layer 3.

In other words, the first and the second polymeric material foam are preferably made of the same polymer, and in addition the second polymeric material foam has a lower nominal density than the first polymeric material foam.

In greater detail, the density of the second polymeric material foam is preferably at least 20% lower than that of the first polymeric material foam.

Even more specifically, the density of the second polymeric material foam preferably ranges between 0.25 and 0,40 $Kg/dm^3$ (kilograms per cubic decimetre).

In a different embodiment, however, the plate-like pad 4 may also be made of a different polymeric material than that forming the shock-absorbing layer 3. Clearly, the compression elasticity modulus and/or the resilience of the second polymeric material foam must in any case be lower than those of the first polymeric material foam.

With reference to FIGS. 3, 4, 5 and 6, in turn, the outsole 2 is preferably provided with at least one increased deformability sector 5, which is locally aligned with the plate-like pad 4, has a perimeter preferably surrounding and optionally also approximating by excess that of the plate-like pad, 4 and is structured so as to be able to elastically introflex into the shock-absorbing layer 3, compressing the above plate-like pad 4.

In greater detail, the outsole 2 preferably has, at the increased deformability sector 5, at least one and more conveniently a plurality of small annular grooves 6, which are separate and distinct from the recesses, furrows and/or channels that surround the ground resting knobs, and are arranged and structured so as to locally increase the bending deformability of the outsole 2.

Preferably, some annular grooves 6 are moreover one inside the other, and the outermost of the annular grooves 6 preferably surrounds and delimits the increased deformability sector 5, advantageously substantially seamlessly.

In addition, the thickness s of plate-like pad 4 preferably increases more or less progressively from the perimeter of the pad, in order to control the pliability of the underlying increased deformability sector 5.

With reference to FIGS. 3 to 6, in particular, the sole assembly 1 is preferably provided with at least a first plate-like pad 4 embedded in the rear part of the shock-absorbing layer 3, i.e. in the part of the layer extending beneath the user's hindfoot area; and with at least a second plate-like pad 4 embedded in the front part of the shock-absorbing layer 3, i.e. in the part of the layer extending beneath the user's forefoot area.

Preferably, the first and/or the second plate-like pad 4 also has/have a compression elasticity modulus and/or a resilience at least 20% lower than those of the shock-absorbing layer 3.

In turn, the outsole 2 is preferably provided with at least a first increased deformability sector 5 that is locally aligned to the first plate-like pad 4, and with at least a second increased deformability sector 5 that, instead, is locally aligned to the second plate-like pad 4. With reference to FIGS. 3 to 6, in the example shown, in particular, the sole assembly 1 is preferably provided with a rear plate-like pad 4 which is located in the rear part of the shock-absorbing layer 3, straddling the centreline of the shock-absorbing layer 3, so as to be roughly aligned to the heel of the user's foot; and with a pair of front plate-like pads 4, advantageously oblong in shape, which are arranged spaced side by side to each other in the front part of the shock-absorbing layer 3, advantageously on opposite sides of the centreline of the shock-absorbing layer 3, so as to be roughly aligned to the metatarsal area of the user's foot.

Preferably the thickness s of at least one, and more advantageously of each plate-like pad 4 moreover increases substantially linearly starting from the perimeter of the pad.

In addition, the shock-absorbing layer 3 and the front and rear plate-like pads 4 are preferably made of polyurethane foam, and are advantageously manufactured by overmoulding.

Preferably, the density of the polyurethane foam forming the rear plate-like pad 4 moreover has a value ranging between 50% and 70% of the density of the polyurethane foam forming the shock-absorbing layer 3.

The density of the polyurethane foam forming each front plate-like pad 4, on the other hand, has a value preferably ranging between 40% and 60% of the density of the polyurethane foam forming the shock-absorbing layer 3.

Preferably, the density of the polyurethane foam forming each front plate-like pad 4 is moreover less than the density of the polyurethane foam forming the rear plate-like pad 4.

In turn, the outsole 2 is preferably provided with a rear increased deformability sector 5 that is locally aligned to the rear plate-like pad 4, and with a pair of front increased deformability sectors 5 that are arranged spaced side by side to each other, each aligned with a respective front plate-like pad 4.

With reference to FIGS. 1, 2, 3 and 5, the sole assembly 1 preferably additionally comprises a rear insert 7, separate and distinct from the shock-absorbing layer 3, which has a rigid or semi-rigid, substantially plate-like structure, is advantageously made of polymeric material and is located on the rear part of the shock-absorbing layer 3, on the opposite side with respect to the outsole 2.

In greater detail, the rear insert 7 preferably has a monolithic structure and is preferably made of thermoplastic polyurethane.

In addition, the rear insert 7 is preferably contiguous and attached in a substantially immovable manner to the shock-absorbing layer 3, advantageously by gluing or overmoulding.

Operation of the sports footwear 100 is easily inferable from the above description and requires no further explanation.

As regard the sole assembly 1, on the other hand, experimental tests have shown that the presence of the plate-like pad(s) 4 allows the outsole 2 to adapt more efficiently to the morphology of the ground, thus improving the grip on the roughness of the ground.

Indeed, the presence of the plate-like pad(s) 4 allows the protruding knobs of the outsole 2 to tilt so that they can locally follow the profile of the roughness of the ground, resulting in greater grip.

The advantages connected to the particular structure of the sole assembly 1 are noteworthy.

The presence of the plate-like pad(s) 4 in combination with the increased deformability sector(s) 5 on the outsole 2 allows the use, for the shock-absorbing layer 3, of a polymeric material foam which is more resistant to impacts and abrasions from sharp rocks and the like, without however reducing the ability of the outsole 2 to adapt to the morphology of the supporting ground.

Lastly, it is clear that modifications and variations may be made to the sole assembly 1 and the sports footwear 100 without however departing from the scope of the present invention.

For example, the plate-like pad(s) 4 may be made separately from the shock-absorbing layer 3, and then be firmly attached within the respective housing seats 4*a* by gluing, preferably using a polyurethane-based glue.

Figure 7:
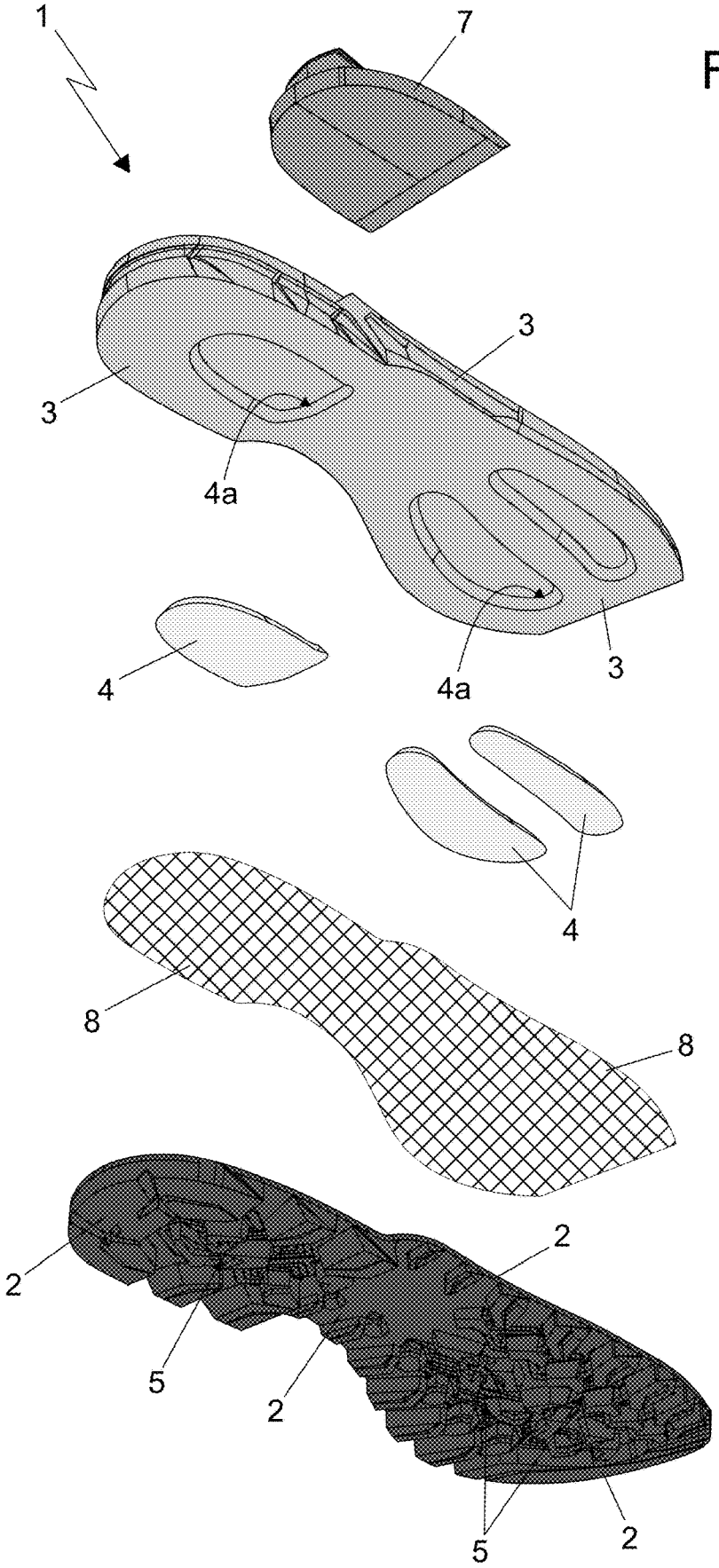
FIG. 7 is a partially exploded view of a variation embodiment of the sole assembly shown in the previous figures.

With reference to FIG. 7, in addition, the sole assembly 1 may also comprise a cohesion net 8 advantageously made of polymeric material, which is placed between the outsole 2 and the shock-absorbing layer 3 and is adapted to hold the plate-like pad(s) 4 within the shock-absorbing layer 3.

In addition, the cohesion net 8 is preferably attached to the surface of the shock-absorbing layer 3 and of the plate-like pad(s) 4 via a polyurethane glue, and has the function of distributing the deformation load, thus making the deformation/collapse of the boundary areas between the shock-absorbing layer 3 and the plate-like pad(s) 4 more homogeneous and uniform.

Clearly, the cohesion net 8 may also be embedded in the shock-absorbing layer 3 and in the plate-like pad(s) 4, preferably by co-moulding.

Finally, in a more sophisticated not-shown embodiment, the sole assembly 1 may also comprise an additional stiffening insert, which has an oblong and rigid or semi-rigid plate-like structure, and is firmly attached/coupled to the shock-absorbing layer 3, above the plate-like pad(s) 4, so as to give greater torsional and/or flexural rigidity to the sole assembly 1 as a whole.

In greater detail, the additional stiffening insert is preferably at least partially embedded in the shock-absorbing layer 3, clearly above the plate-like pad(s) 4.

Even more specifically, the stiffening insert is preferably overmoulded on the shock-absorbing layer 3, or vice versa.

Lastly, the additional stiffening insert preferably has a monolithic structure and is advantageously made of polymeric or composite material.

The invention claimed is:

1. A sole assembly for sports footwear having an oblong plate-like structure and comprising:

an outsole with a treaded profile, which is adapted to grip the ground and is made of polymeric material with a high friction coefficient;

at least one shock-absorbing layer with plate-like and elastically deformable structure, separate and distinct from the outsole, which is made of a first polymeric material foam and is located immediately above the outsole;

at least one plate-like pad with elastically deformable structure, separate and distinct from said outsole and said shock-absorbing layer, which is embedded inside the shock-absorbing layer close to the outsole, and is made of a second polymeric material foam having a compression elasticity modulus and/or a resilience lower than those of the shock-absorbing layer; and said outsole comprising at least one increased deformability sector which is locally aligned with said plate-like pad and has a perimeter surrounding the plate-like pad, the at least one increased deformability sector being configured to introflex into the at least one shock absorbing layer to compress the at least one plate-like pad.

2. The sole assembly according to claim 1, wherein the perimeter of said at least one increased deformability sector approximates by excess that of the plate-like pad.

3. The sole assembly according to claim 2, wherein the outsole comprises a series of ground resting knobs delimited by recesses, furrows, and/or channels, the outsole having at said increased deformability sector, one or more annular grooves that are separate and distinct from the recesses, furrows and/or channels that surround the ground resting knobs, the one or more annular grooves being structured and located so as to locally increase a bending deformability of the outsole.

4. The sole assembly according to claim 3, wherein at least one of the annular grooves is surrounded by at least one other one of the annular grooves.

5. The sole assembly according to claim 1, wherein a thickness of the at least one plate-like pad increases in a substantially progressive way starting from a perimeter of said at least one plate-like pad.

6. The sole assembly according to claim 1, wherein the at least one plate-like pad is embedded in the shock-absorbing layer so as to be contiguous to the outsole.

7. The sole assembly according to claim 1, wherein the compression elasticity modulus and/or the resilience of the second polymeric material foam is/are at least 10% lower than those of the first polymeric material foam.

8. The sole assembly according to claim 1, wherein said first and said second polymeric material foam are made of the same polymer, and said second polymeric material foam has a density lower than that of the first polymeric material foam.

9. The sole assembly according to claim 8, wherein the density of the second polymeric material foam is at least 20% lower than the density of the first polymeric material foam.

10. The sole assembly according to claim 8, wherein said at least one shock-absorbing layer and said at least one plate-like pad are made of polyurethane foam or of ethylene-vinyl-acetate foam.

11. The sole assembly according to claim 8, wherein said first polymeric material foam has a density ranging between 0.35 and 0.45 $Kg/dm^3$ and/or wherein said second polymeric material foam has a density ranging between 0,25 0.25 and 0.40 $Kg/dm^3$.

12. The sole assembly according to claim 1, further comprising at least a first plate-like pad embedded in a first housing seat in a rear part of the shock-absorbing layer, and at least a second plate-like pad embedded in a second housing seat in a front part of the shock-absorbing layer, that first and second housing seats being distinct recesses that are spaced apart and not connected to one another, the first and second plate-like pads being distinct pads that are not connected to one another.

13. The sole assembly according to claim 11, further comprising a pair of the second plate-like pads that are arranged spaced side by side to each other in the front part of said shock-absorbing layer, on opposite sides of a centreline of said shock-absorbing layer.

14. The sole assembly according to claim 1, further comprising a substantially plate-like rear insert, separate and distinct from the shock-absorbing layer, which has a rigid or semi-rigid structure and is located on a rear part of the shock-absorbing layer, on an opposite side with respect to the outsole.

15. Footwear comprising an upper and a sole assembly according to claim 1, wherein the sole assembly is firmly attached to a lower part of the upper and is dimensioned so as to cover and protect a sole of a user's foot.

16. The sole assembly according to claim 1 further comprising:

the outsole comprising a base portion having an outer surface, a plurality of ground resting knobs protruding from the outer surface of the base portion, and at least one annular groove formed into the outer surface of the base portion, the at least one annular groove defining the at least one increased deformability sector.

17. The sole assembly according to claim 16 further comprising:

the outsole comprising channels that surround the ground resting knobs, and wherein the at least one annular groove is located within one or more of the channels.

18. The sole assembly according to claim 1 further comprising:

the at least one shock-absorbing layer comprising a lower surface having at least one housing seat; and wherein the at least one plate-like pad is located within the at least one housing seat of the at least one shock-absorbing layer, the at least one plate-like pad having a thickness that is less than a thickness of a surrounding portion of the at least one shock-absorbing layer such that the at least one plate-like pad does not protrude beyond the lower surface of the at least one shock-absorbing layer.

19. The sole assembly according to claim 1 wherein the at least one plate-like pad is fully embedded between the at least one shock-absorbing layer and the outsold such that no portion of the at least one plate-like pad is visible along an exterior of the sole assembly.

20. A sole assembly for sports footwear comprising:

an outsole formed from a polymeric material having a high friction coefficient, the outsole comprising a base portion having an inner surface and an outer surface, and a plurality of ground resting knobs protruding from the outer surface of the base portion;

at least one shock-absorbing layer formed from a first polymeric material foam having a first compression elasticity modulus and/or a first resilience, said at least one shock-absorbing layer comprising an upper surface and a lower surface opposite the upper surface, the lower surface comprising at least one housing seat, the at least one shock-absorbing layer being attached to the outsole with the lower surface of the at least one shock-absorbing layer at least partially in contact with the inner surface of the base portion of the outsole;

at least one plate-like pad formed from a second polymeric material foam having a second compression elasticity modulus and/or a second resilience that is lower than the first compression elasticity modulus and/or the first resilience of the shock-absorbing layer, said at least one plate-like pad being disposed within the at least one housing seat of the shock-absorbing layer and being embedded between the at least one shock-absorbing layer and the outsole; and said outsole comprising at least one annular groove formed into the outer surface of the base portion to define at least one increased deformability section of the outsole that is locally aligned with said plate-like pad.

* * * * *